US005098812A

United States Patent [19]

Yamazaki

[11] Patent Number: 5,098,812

[45] Date of Patent: Mar. 24, 1992

[54] PHOTOSENSITIVE DEVICE AND MANUFACTURING METHOD FOR THE SAME

[75] Inventor: Shunpei Yamazaki, Tokyo, Japan

[73] Assignee: Semiconductor Energy Laboratory Co., Ltd., Kanagawa, Japan

[21] Appl. No.: 377,058

[22] Filed: Jul. 10, 1989

Related U.S. Application Data

[62] Division of Ser. No. 296,211, Jan. 12, 1989, abandoned.

[30] Foreign Application Priority Data

Jan. 25, 1988 [JP] Japan ..... 63-15584

[51] Int. Cl.[5] ..... G03G 5/047

[52] U.S. Cl. ..... 430/132; 427/41; 204/168; 430/58

[58] Field of Search ..... 430/58, 66, 67, 132

[56] References Cited

U.S. PATENT DOCUMENTS 4,749,636 6/1988 Iino et al. ..... 430/58
4,833,055 5/1989 Kazawa et al. ..... 430/66
4,882,256 11/1989 Osawa et al. ..... 430/132 X

FOREIGN PATENT DOCUMENTS 61-264355 11/1986 Japan ..... 430/66

*Primary Examiner*—Roland Martin
*Attorney, Agent, or Firm*—Sixbey, Friedman, Leedom & Ferguson

[57] ABSTRACT

A photosensitive device is described. The photosensitive member of the device is made of an organic photoconductive film which is suitable for mass-production and unlikely to have cracks therein. The photoconductive film is provided with an abrasion-proof surface by coating the same with an amorphous film having a vickers hardness higher than 2000 Kg/mm$^2$.

19 Claims, 1 Drawing Sheet

PHOTOSENSITIVE DEVICE AND MANUFACTURING METHOD FOR THE SAME

This is a divisional application of Ser. No. 07/296,211, filed Jan. 12, 1989 now abandoned.

BACKGROUND OF THE INVENTION

The present invention relates to photosentitive device and manufacturing method for the same.

Amorphous silicon photosensitive semiconductor films have been deposited on the printing drums of electrostatic photocopying machines by means of plasma CVD techniques, which utilize high frequency or direct current electric energies. The photosensitive films have to be formed to thickness as large as 5 microns. There are however several shortcomings associated with such a thick semiconductor film. Namely, cracks occur in the film; the surface is not smooth; and the film catches flakes of the product which come off from the internal surface of the reaction chamber of CVD. Because of this, though amorphous silicon semiconductors are believed to be suitable for forming photosensitive films of photocopying machines, the commercialization thereof has been deferred.

On the other hand, photosensitive organic resin films can be formed to a sufficient thickness without causing the above mentioned shortcomings. This method is desirable since printing drums can be produced only by coating the resin thereon. Particularly, mass-production is possible on a low-cost basis in accordance with this method. The life time of the printing drums, however, is relatively short. After 50–70 thousands times copying, the quality of copies becomes degraded.

SUMMARY OF THE INVENTION

It is an object of the present invention to provide a photosensitive device having a long life time and a manufacturing method for the same.

It is another object of the present invention is to provide a photosensitive device and a manufacturing method therefor, in which few cracks occur.

It is a further object of the present invention is to provide a photosensitive device and a manufacturing method therefor, in which the device is provided with a hard and smooth surface.

DETAILED DESCRIPTION OF THE PREFERRED EMBODIMENTS

Figure 1:
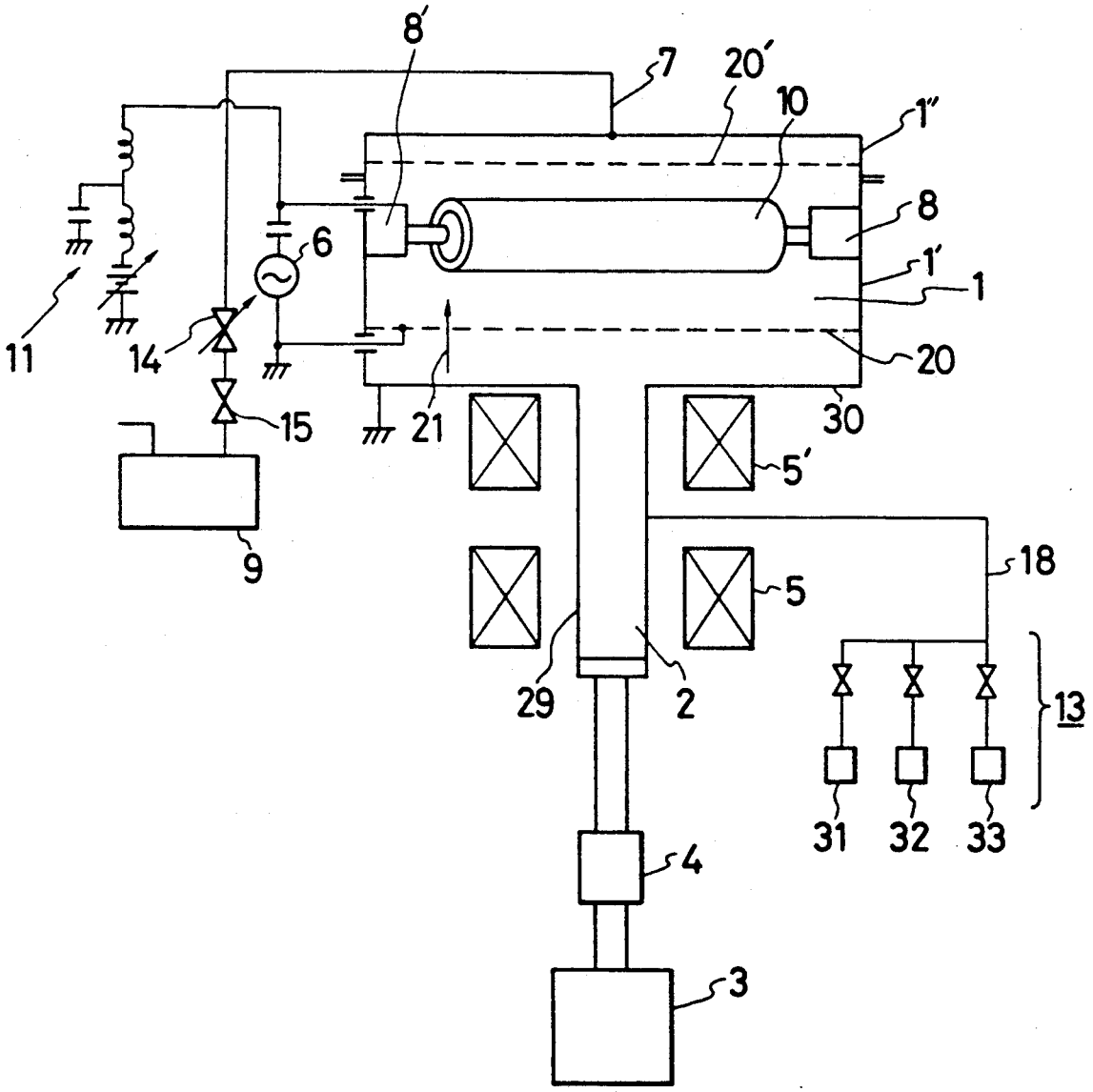
FIG. 1 is a schematic diagram showing an apparatus for manufacturing photosensitive devices in accordance with the present invention.

Referring now to FIG. 1, a plasma CVD apparatus for depositing carbon films is illustrated in accordance with the present invention. The apparatus comprises a vacuum chamber 1, a quartz tube 29 coupled with and projected from the vacuum chamber 1, a microwave generator 3 coupled with the tube 29 through an isolater 4, Helmholtz coils 5 and 5' encircling the tube 29, a substrate holder 8 and 8' a higher frequency (or direct current) power supply 6 connected between the substrate holder 8 and 8' and a meshed electrode 20, a reactive has introduction system 13, an evacuation system 9 connected to the vacuum chamber 1 through control valve 14 and a valve 15. The tube 29 is made of a synthetic quartz and defines a resonating space therein. The meshed electrode 20 functions to make uniform gas flow passing therethrough from the tube 29. In the opposite side, a similar mesh as homozinizer is provided for making uniform the evacuation of drawing gas. The upper lid 1'' of the vacuum chamber 1 is removable from the lower proper in order to provide an access to the interior of the apparatus. A printing drum can be admitted into and removed from the chamber through the access. The substrate holder 8 and 8' is adapted to supporting a printing drum 10 and rotate the printing drum around its axis.

The surface of the drum 10 to be treated is coated in advance with an organic photoconductive (OPC) material such as poly-N-vinylkalvazole (PVK) and trinitrofluorulenone. The drum is made of Al, Cr, Mo, Ir, Nb, V, Ti, Pd or Pt. An amorphous silicon p-type or n-type semiconductor film and/or a barrier film may be further formed on the photoconductive film if necessary. The barrier film may be made of polyethylene, polycarbonate, polyurethane, barilene and so forth. After mounting the coated substrate drum 10 on the holder 10; the chamber 1 is evacuated by means of the evacuating system 11. Hydrogen and methane are leaked into the tube 29 respectively through the lines 31 at 200 SCCM and the line 32 at 200 SCCM. Furthermore, $N(CH_3)_3$, $B(CH_3)_3$, $B_2H_6$ or $PH_3$ diluted with hydrogen may be introduced from the line 33 if desired. The introduction of trivalent atoms make semiconductive the carbon film to be subsequently formed. The resonating space 2 is subjected to a magnetic field of 875 Gauss. 2.45 GHz microwaves are inputted from the generator 3 at 30 W to 1.3 KW through the insulator 4 in order to cause a whistler mode resonance. The reactive gas including methane absorbs the microwave energy and is excited by virtue of the resonance.

The excited gas then enters the vacuum chamber 1 through the meashed electrode 20. In order to induce a plasma electric field between the electrde 20 and the printing drum 10, a 13.56 MHz electric power is inputted from the power supply 6 at 50 W to 1 KW (0.03 to 3 $W/cm_2$). Preferably, a DC bias is superimposed on the high frequency power at the drum side by a bias means 11. The negative bias is in the range of −50 to −500, preferably −100 to −300. When no DC bias is applied, the carbon film is produced with a relatively much amount of hydrogen atoms involved therein, and thereafore the energy gap is 1.7 to 3.5 eV. When a negative bias voltage is applied to the substrate side, the hydrogen amount involved in the carbon product is decreased and the optical energy gap becomes 1.0 to 2.0 eV. Eventually, methane is decomposed and light transmissive carbon film is formed on the surface of the printing drum 10. By this carbon film, an abrasion-proof surface is provided with the organic film. The thickness of the film is 0.04 to 4.0 microns, preferably 0.5 to 2.0 microns. The substrate temperature of the drum is kept under 200° C., e.g. −100° C. to +200° C., preferably −100° C. to +150° C. This relative low temperature is needed in order to avoid heat damage to the underlying organic film. The inside of the apparatus is cleaned by high frequency plasma ashing after completion of the deposition.

In accordance with experiments, the deposition speed was 500 to 1000 Å/min. The Vickers hardness of the carbon films were 2000 to 4000 $Kg/mm^2$. The Vickers hardness higher than 2000 $Kg/mm^2$ makes it possible to carry out more than 200 thousands times copying. The thermal conductivity of the film was 2.5 W/cm deg.

without the pre-excitation by microwaves, the deposition speed was decreased to 100–200 Å.

EXPERIMENT 1

The reactive gas was composed of hydrogen and methane at 1:1 which were introduced at 200 SCCM respectively from the lines 31 and 32 of the gas feeding system 18. The gas pressure in the reactive chamber was 0.1 Torr. The input power was 2.45 GHz microwaves at 500 W introduced into the resonating space in the tube 29 which was subjected to a magnetic field having a resonating strength of 875 Gauss. In the vacuum chamber 1, glos discharge was caused by applying between the drum 10 and the electrode 20 an electric power of 13.56 MHz at 500 W in order to re-excite the pre-excited reactive gas entering from the resonating space. The other deposition conditions were same as described above. Then, amorphous carbon films and amorphous carbon film including diamond microcrystals were deposited at 30 Å/sec for 15 min. Exhausted gas was removed via the line 7 by means of the evacuating system. The specific resistance of the carbon film was $10^{10}$ ohm cm. The Vickers hardness was 2300 Kg/mm$^2$. The optical energy was 1.8 eV. The carbon films were characterized by $sp^3$ bonds.

EXPERIMENT 2

The procedure of Experiment 1 was repeated in the same manner with exceptions as follow. The deposition was carried out on a photosensitive drum of 25 cm diameter and 30 cm length made of aluminum. The drum is coated with an organic photoconductive film. The reactive gas was neither heated nor cooled. The electric power applied between the drum and the electrode 20 for electric discharge was a DC power of 300 W. The drum was biassed by −200 V. In this condition, a 0.4 micron thick carbon film was deposited at 200 Å/min.

EXPERIMENT 3

The procedure of Experiment 1 was repeated except for the following conditions. The deposition was made on drums of the same type as used in Experiment 2. The DC bias was −400 V. A 0.5 micron thick carbon film was deposited on the drum while the drum was simultaneously rotated and moved in the forward-back and right-left directions.

The drums coated with the carbon films were subjected to a temperature variation cycle of room temperatures <−>150° C. 100 times. Out of 300 test samples, none of them was observed with peeling. Also, throughout the 300 samples, no appreciable decrease in contrast of copied images was observed when the samples was actually used in a copying machine and the contrast of copies was compared before and after the temperature variation test. Although the copying machine was provided with a squeegee which strips a paper from the drum, the carbon film and the underlying organic photoconductive film did not come off from the drum. The squeegee was made of a metal coated with a carbon film.

While several embodiments have been specifically described, it is to be appreciated that the present invention is not limited to the particular examples described and that modifications and variations can be made without departure from the scope of the invention as defined by the append claims as follows. The methane gas may be replaced by other carbon products such as $C_2H_4$, $C_2H_2$, $CH_3OH$ and $C_2H_5OH$. By use of an alcohol, the deposition speed can be increased several times. The reactive gas may be doped with a halogen or silicon ($SiH_2(CH_3)$).

We claim:

1. A method of manufacturing photosensitive devices comprising the steps of:

forming an organic photoconductive film on a printing drum;

placing said printing drum in a reaction chamber wherein said drum is supplied with a negative bias voltage;

introducing a reactive gas including a carbon compound into said reaction chamber;

exciting said reactive gas including a carbon compound into said reaction chamber;

depositing an amorphous carbon film for a length of time sufficient to provide a thickness of the amorphous carbon film in the range of 0.04 micrometers to 4 micrometers for providing an abrasion-proof surface on said organic photoconductive film.

2. The method of claim 1 wherein said exciting step is performed by inputting microwaves in a magnetic field.

3. The method of claim 2 wherein a whistler mode resonance takes place between the ractive gas and the microwave in the magnetic field.

4. The method of claim 2 wherein said reactive gas is re-excited by plasma discharge.

5. The method of claim 2 wherein the said electric power is supplied by causing glow discharge between said printing drum and an electrode provided in said reaction chamber.

6. The method of claim 5 wherein said electric power is a high frequency electric power.

7. The method of claim 6 wherein a negative bias of −50 to −500 V is applied to said drum.

8. The method of claim 1 wherein said drum is biased during said depositing step.

9. The method of claim 1 where said carbon film comprises $sp^3$ bonds.

10. The method of claim 1 where the carbon film is formed directly on the organic photoconductive film.

11. The method of claim 1 where the deposition speed of the carbon film is in the range of 500 to 1000 Å/minute.

12. The method of claim 1 where the reactive gas is neither heated nor cooled.

13. The method of claim 1 where said printing drum comprises a metal.

14. The method of claim 13 where said metal is selected from the group consisting of Al, Cr, Mo, Ir, Nb, V, Tl, Pd, or Pt.

15. A method according to claim 1, wherein said negative bias voltage is within the range of −50 to −500 volts.

16. A method according to claim 15, wherein said negative bias voltage is within the range of −100 to −300 volts.

17. A method of manufacturing photosensitive devices comprising the steps of:

forming an organic photoconductive film on a printing drum;

placing said printing drum in a reaction chamber wherein said drum is supplied with a negative bias voltage;

introducing a reactive gas including a carbon compound into said reaction chamber;

exciting said reactive gas by an electric power; and depositing an amorphous carbon film for a length of time sufficient to provide a thickness of the amorphous carbon film in the range of 0.04 micrometers to 4 micrometers for providing an abrasion-proof surface on said orgainc photoconductive film, wherein said amorphous carbon is doped with silicon.

18. A method of manufacturing photosensitive devices comprising the steps of:

forming an organic photoconductive film on a printing drum;

placing said printing drum in a reaction chamber wherein said drum is supplied with a negative bias voltage;

introducing a reactive gas including a carbon compound into said reaction chamber;

exciting said reactive gas by an electric power; and depositing an amorphous carbon film for a length of time sufficient to provide a thickness of the amorphous carbon film in the range of 0.04 micrometers to 4 micrometers for providing an abrasion-proof surface on said organic photoconductive film, wherein said amorphous carbon is doped with an impurity selected from the group consisting of B, P and N.

19. A method according to claim 1, 17 or 18 wherein said carbon coating is formed at a drum temperature in the range from −100° C. to 150° C.

* * * * *